US006321507B1

(12) United States Patent
Copeland et al.

(10) Patent No.: US 6,321,507 B1
(45) Date of Patent: Nov. 27, 2001

(54) APPARATUS FOR PACKAGING INSULATION MATERIAL

(75) Inventors: Thomas Paul Copeland, Heath; James D. Haaser, Lancaster, both of OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/430,718

(22) Filed: Oct. 29, 1999

(51) Int. Cl.[7] ..... B65B 63/04

(52) U.S. Cl. ..... 53/118; 53/116; 53/214; 100/5; 100/40; 100/87; 100/88

(58) Field of Search ..... 53/118, 116, 157, 53/51, 214, 211; 226/23; 242/918, 541.2, 541.3; 100/88, 5, 40, 87

(56) References Cited

U.S. PATENT DOCUMENTS 2,893,189 * 7/1959 Lancaster ..... 53/211
3,504,835 * 4/1970 Callan ..... 226/23
3,710,927 * 1/1973 Alsted ..... 198/202
3,964,235 6/1976 Miller et al. .
4,114,530 9/1978 Miller .
4,164,177 * 8/1979 Canfield ..... 100/40
5,129,212 * 7/1992 Duffey et al. ..... 53/426
5,425,512 * 6/1995 Bichot et al. ..... 242/541.3
5,966,908 * 10/1999 Philipp et al. ..... 53/450
6,109,427 * 8/2000 Hosch et al. ..... 198/835

* cited by examiner

*Primary Examiner*—Peter Vo
*Assistant Examiner*—Thanh K. Truong
(74) *Attorney, Agent, or Firm*—Inger H. Eckert; Stephen W. Barns

(57) ABSTRACT

A belt roll-up machine which includes at least two endless belts. The endless belts have portions that overlap one another. The overlapping portions of the belts form a loop. A compressible strip of insulation material may be rolled in the loop.

21 Claims, 12 Drawing Sheets

APPARATUS FOR PACKAGING INSULATION MATERIAL

TECHNICAL FIELD AND INDUSTRIAL APPLICABILITY OF THE INVENTION

This invention relates in general to an apparatus for packaging a roll product, and in particular, to an apparatus for in-line packaging of insulation material.

BACKGROUND OF THE INVENTION

Glass fiber insulation products are typically packaged either as flat or folded batts in bags, or as rolls of long insulation blankets. Typically, two, three, or more strips of building insulation are formed in side-by-side relationship and discharged longitudinally off the end of the production line. Each of the strips or blankets comprises a layer of compressible fibers, optionally held together by a binder and, in some instances, adhered to a facing. The insulating strip is commonly either about 16 or 24 inches wide, with the thickness of the fibrous insulating layer being at least about 3.5 inches. A lengthy roll of such a strip, capable of covering up to 75 square feet, for example, can be quite bulky if not compressed substantially during packaging. In fact, the compression during packaging should be limited only by the degree to which the fibers can return or recover substantially to the desired thickness of the layer after the package roll is opened.

Glass fiber insulation packaging machines for rolling glass fiber insulation products into rolls are of two general types. The first employs a mandrel to which the leading edge of the insulation blanket is attached for rolling up. These machines are somewhat deficient in that they typically overcompress the leading portion of the blanket, resulting in loss of recovery and insulation value. The other packaging machine is the belt roll-up machine which uses a single endless belt which forms a loop in itself located in the path of a compressible strip of insulation material being lineally moved toward the belt from the production line.

The belt roll-up machine can receive a compressible strip of insulation directly from the end of a production line. As the compressible strip is moved into the loop, the belt is moved in a manner such that the strip is rolled on itself with the facing sheet of the insulation strip, if any, facing outwardly. The belt is maintained under tension as the roll is wound so that the pressure on the roll is increased as the loop enlarges to accommodate the ever increasing diameter of the roll being packaged. The compressible strip is cut to a predetermined length on the production line and, as the trailing end of the strip is moved toward the loop, adhesive tape is applied thereto.

While the use of conventional belt roll-up machines has been successful, it has a limited ability to efficiently package insulating strips of various widths. Proper operation of the belt roll-up machine requires the total width of all the insulating strips to be substantially equal to the width of the belt. Therefore, an endless belt that is 48 inches wide may be used to efficiently package three insulating strips that are 16 inches wide or two insulating strips that are 24 inches wide. An endless belt that is 72 inches wide may be used to efficiently package three insulating strips that are 24 inches wide. In both cases, the sum of the strip widths is equal to the width of the belts. When packaging insulating strips that do not utilize the entire width of the belt, a partial width insulation strip is usually packaged along with the full-width strips. This creates waste because, after packaging, the partial width roll must be recycled as loose fill insulation or admix. For example, if two insulating strips that are 20 inches wide are being packaged on a belt roll-up machine that is 48 inches wide, an eight inch wide strip of waste will be created. Similarly, if three insulating strips that are 20 inches wide are being packaged on a belt roll-up machine that is 72 inches wide, 12 inches of waste will be created. Attempts to operate the belt roll-up with less than a full width of insulation results in telescoping. Telescoping is the condition where concentric layers of the rolled insulating strips shift laterally or axially. Telescoping complicates the wrapping of the roll product and renders the roll product difficult to stack. It is desirable to produce a roll product more efficiently and effectively while minimizing any waste or telescoping of the roll product.

SUMMARY OF THE INVENTION

The above drawbacks as well as other limitations not specifically enumerated are achieved by a belt roll-up machine comprising at least two endless belts having portions that overlap one another. The overlapped belts form a loop in which a compressible strip of insulation material can be rolled. The degree of overlap may be controlled to allow the belt roll up groups of insulation strips having a variety of widths without generating waste or forming telescoped rolls.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
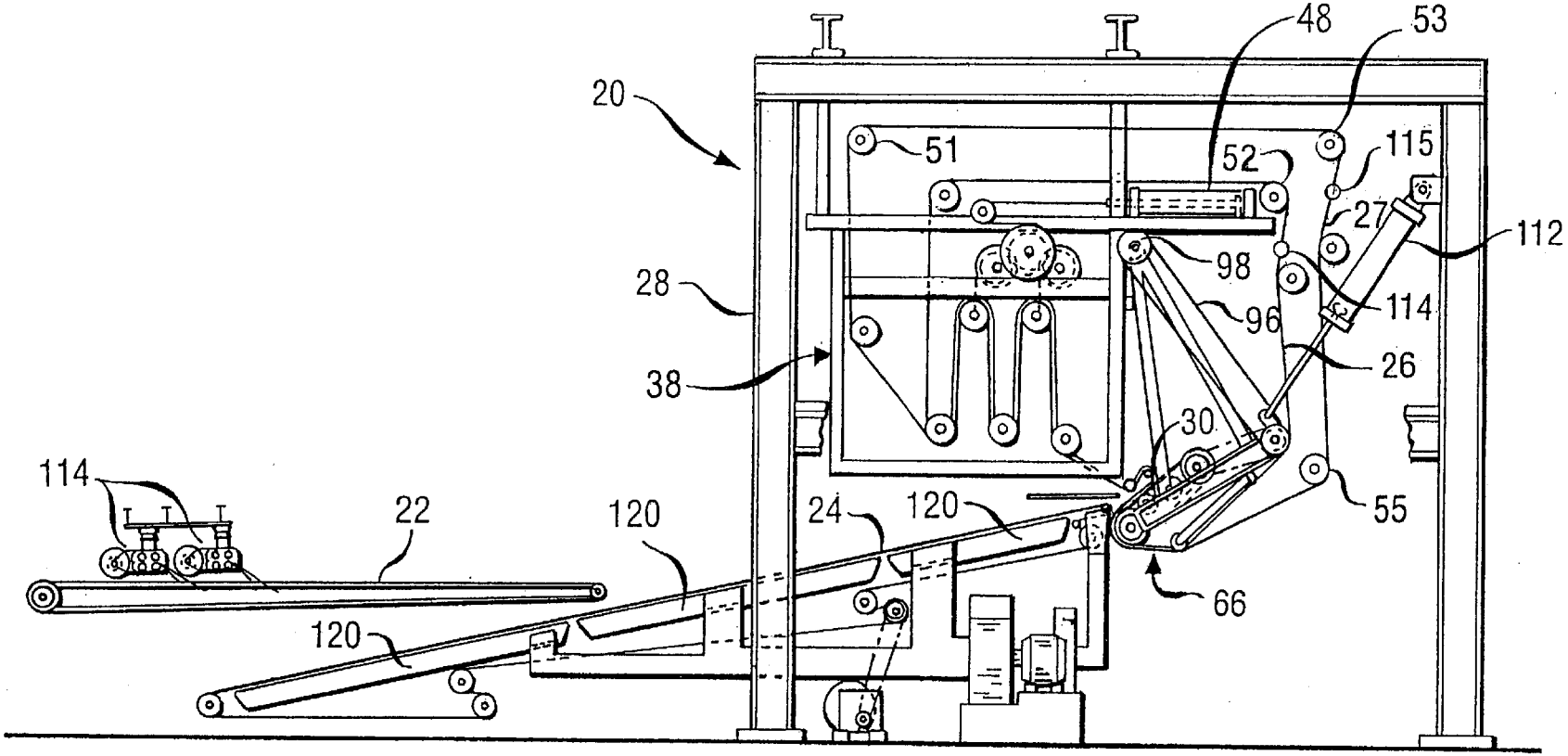
FIG. 1 is a schematic side view in elevation, with parts broken away, of packaging apparatus embodying the invention.

Referring now to the drawings, there is illustrated in FIGS. 1–8, a belt roll-up (BRU) packaging apparatus, shown generally at 20, for a roll product according to a preferred embodiment of the invention. A strip of insulation, specifically an insulating layer of glass fibers, with or without a facing sheet, is fed longitudinally to the packaging apparatus 20 from a production line. The strip is typically cut to a predetermined length on the production line prior to reaching the BRU. It is to be understood that the invention can be used with other fibrous insulation materials, such as mineral wool and fibrous polymer insulation. The insulation is fed from the production line to a supply conveyor 22 and then moved up an inclined conveyor 24 toward a pair of endless belts 26, 27 carried by a main frame 28. The belts 26, 27 overlap (i.e., have overlapping portions) and form a loop or pocket 30 which is in alignment with the inclined conveyor 24 to receive the forward end of the compressible strip of insulation.

Figure 2:
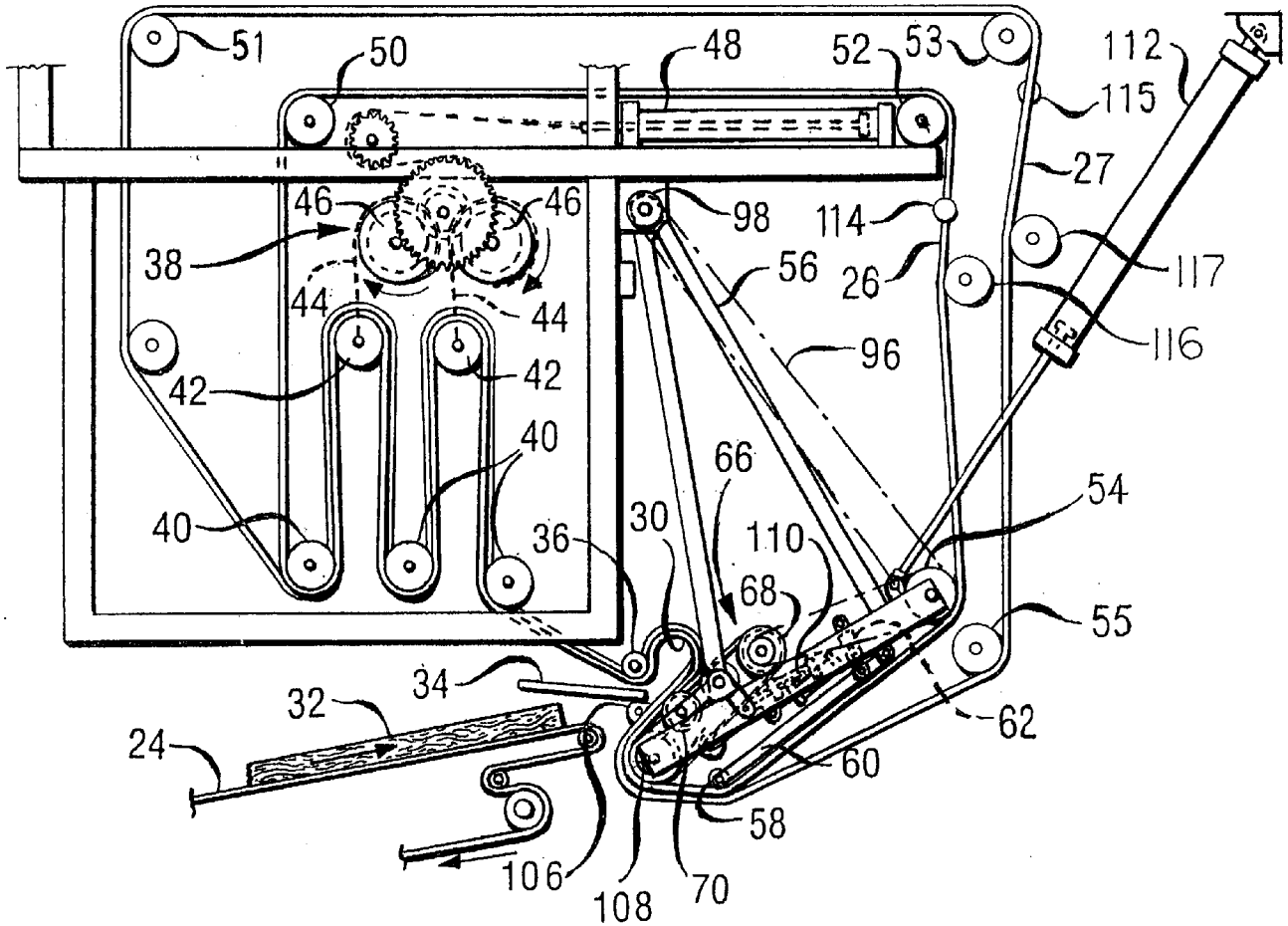
FIGS. 2–5 are enlarged, schematic side views in elevation of a portion of the packaging apparatus showing various components in different positions during the packaging and discharging of a strip of compressible material.
Figure 3:
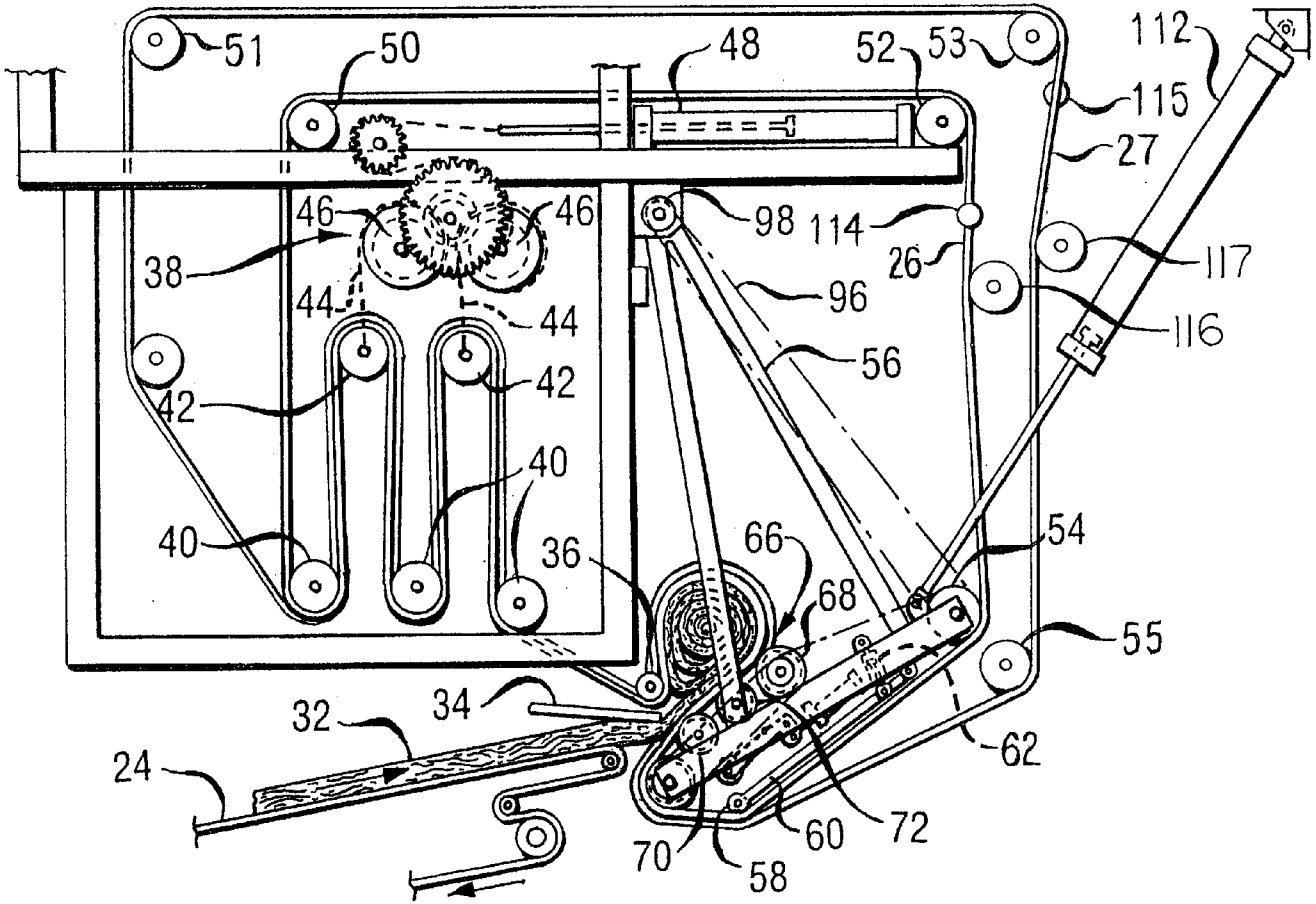
Figure 4:
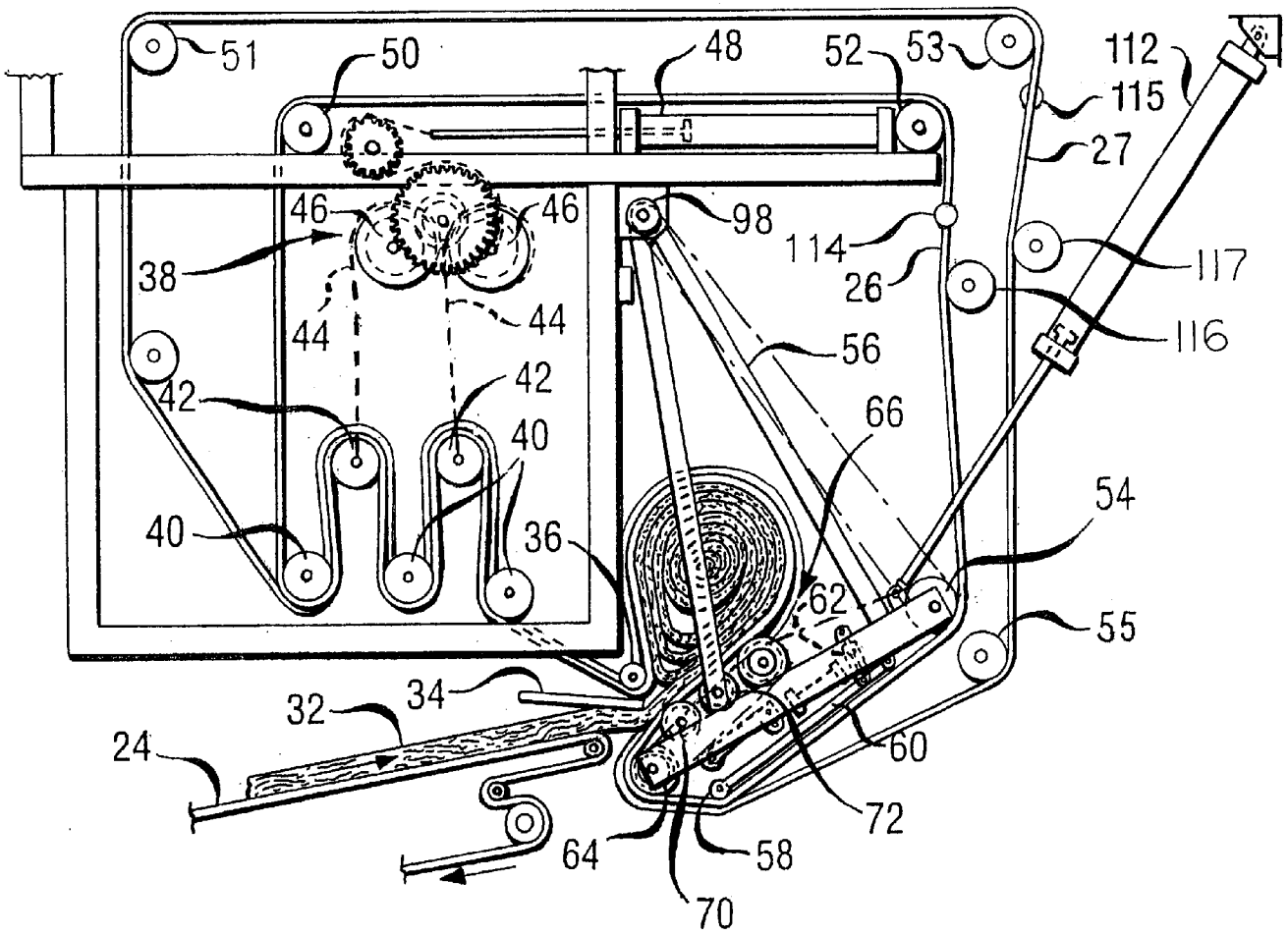

Referring to FIGS. 2 through 5, a strip 32 of insulation is shown moving up the conveyor 24 and directed by a guide plate 34 toward the throat or opening of loop 30. From the loop, the overlapping belts 26, 27 extend around a throat roll 36 to a take-up or tension mechanism, indicated generally at 38. This enables the loop 30 to expand as the insulation rolls up and yet maintains tension on the belts 26, 27 in order to maintain a compressive force or pressure on insulation 32 as each wrap is rolled. The take-up mechanism 38 includes lower, stationary idler rolls 40, and upper, vertically-movable, take-up rolls 42. The rolls 42 are urged upwardly to place the belt in tension but move downwardly as the size of the loop 30 increases. The rolls 42 are supported by chains 44 which are wound on sprockets 46. The chains 44 extend around the sprockets 46 sufficiently to enable the take-up rolls 42 to move between their extreme upper and lower positions, as shown in FIGS. 2 and 4. The sprockets 46 are urged in a clockwise direction, as shown in FIG. 2, by spur gears, cams and a pressure cylinder 48. This mechanism is shown and discussed more fully in U.S. Pat. No. 3,964,235, herein incorporated by reference.

Beyond the take-up mechanism 38, the belts 26, 27 continue around upper entry or idler rolls 50, 51 and guide rolls 52, 53 and around a lower idler rolls 54, 55 carried by the pivotal sub-frame 56. The belts 26, 27 then overlap and extend below a slack control roll 58 which is rotatably carried by a lever 60 pivotally mounted on part of sub-frame 56. The lever is pivotally moved by a hydraulic ram 62 (FIG. 6) which is also pivotally mounted on a portion of the sub-frame 56, the roll 58 controlling the slack in the overlapping belts 26, 27 when the frame 56 is opened. The overlapping belts 26, 27 then extend around the tail roll 64 (FIGS. 4 and 5) before returning to the loop portion 30.

Figure 6:
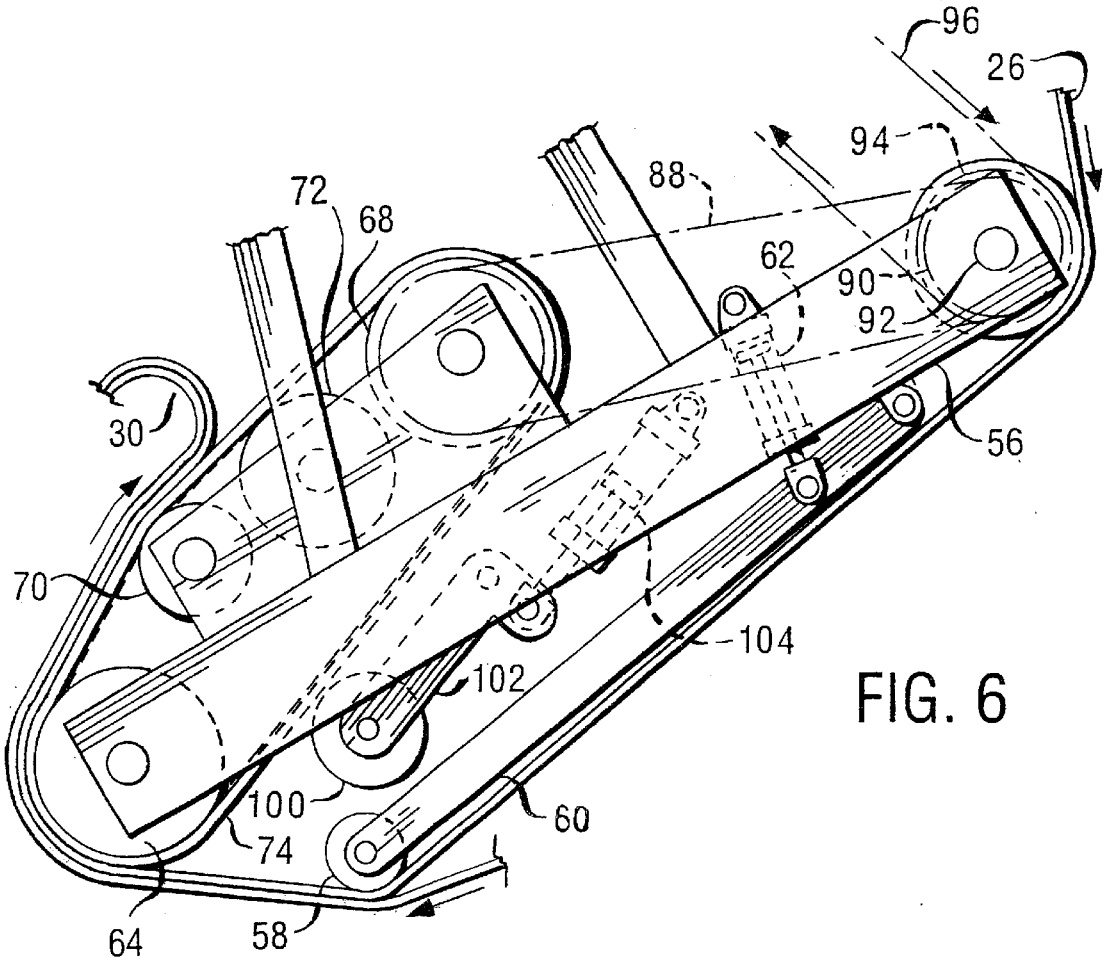
FIG. 6 is a further enlarged, schematic side view in elevation of certain components of the packaging machine according to the invention.
Figure 7:
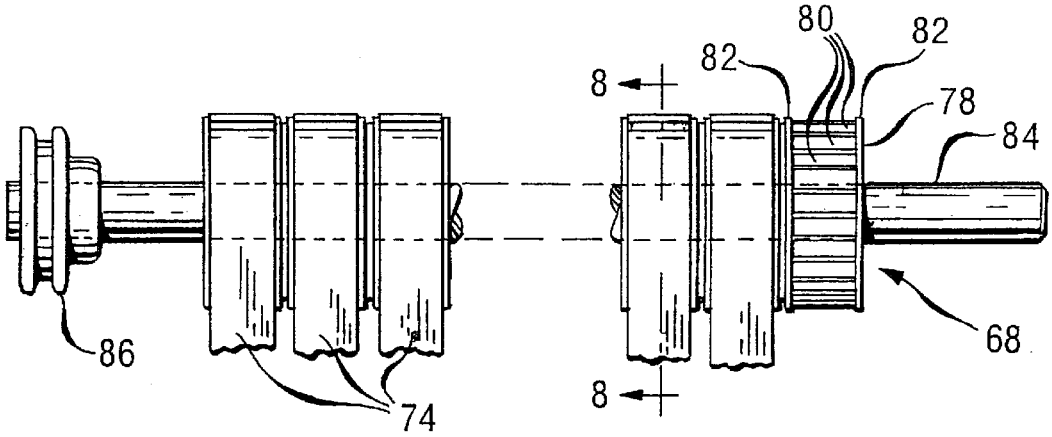
FIG. 7 is a fragmentary plan view of supporting belts and a drive arrangement shown in FIG. 6.
Figure 8:
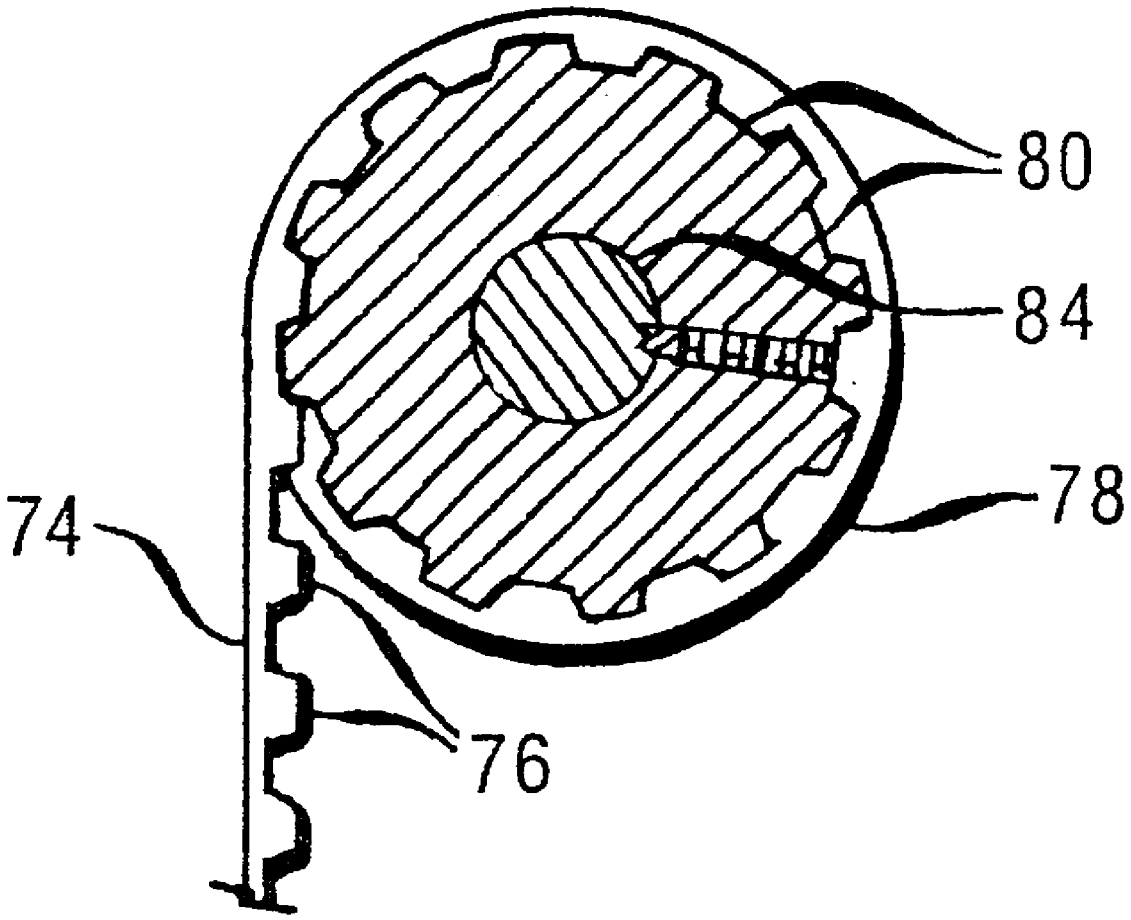
FIG. 8 is a transverse sectional view taken along the line of 8—8 of FIG. 7.

The tail roll 64 is part of supporting conveyor 66 which also has head or drive roll 68 and intermediate idler rolls 70 and 72. These are rotatably carried by a lower portion of pivotal sub-frame 56. The conveyor 66 also includes a plurality of narrow belts 74 (FIGS. 6 and 7) arranged in spaced, side-by-side relationship and extending around tail roll 64 and drive roll 68. The belts 74 may be timing belts with teeth 76 (FIG. 8) on the inner surfaces thereof. As shown in FIGS. 7 and 8, when using timing belts the drive roll 68 consists of a plurality of timing belt pulleys 78 having transverse recesses 80 which receive the teeth 76. The timing belt pulleys 78 also have edge shoulders 82 which maintain the belts 74 in a spaced relationship. The tail roll 64 has a smooth cylindrical surface with collars (not shown) which, along with the shoulders 82, maintain the belts 74 in a spaced apart relationship.

The conveyor 66 and the upper runs of belts 74 are located at an angle of about forty degrees to about fifty degrees from horizontal. This places the loop 30 at an appropriate angle and enables the leading edge of the insulation 32 to turn back on itself more readily to form the first wrap or core of the package.

The drive roll 68 and timing belt pulleys 78 are mounted on and affixed to the drive shaft 84 having a double sprocket 86 thereon. This is connected by chains 88 (FIG. 6) to a sprocket 90 located on a jack shaft 92 and rotated through a drive sprocket 94, a chain 96, and a main drive sprocket 98 (FIG. 1) by a suitable motor on frame 28. As shown in FIG. 6, take-up roll 100 is located below the return run of belts 74 and is mounted on lever 102 connected to ram 104 which urges roll 100 against belts 74.

Pinch roll 106 (FIGS. 2 and 5) urges overlapping belts 26, 27 towards the tail roll 64 and belts 74 to cause the overlapping belts 26, 27 to be driven along with the timing belts 74 when the pinch roll 106 engages the overlapping belts 26, 27. The pinch roll 106 is rotatably mounted on pivoted L-shaped levers 108 which are operated through a hydraulic ram 110. The pinch roll 106 is located downstream from the tail roll 64 so that the pinch roll 106 contacts both belts 26, 27 to synchronize the speed of the overlapping belts 26, 27.

Figure 9:
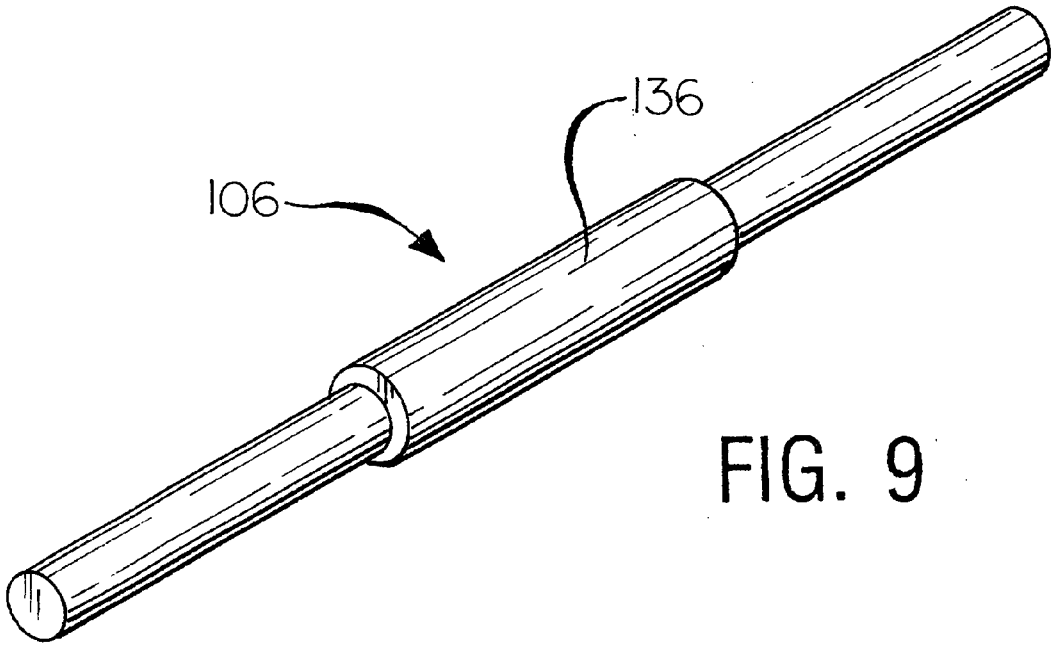
FIG. 9 is a schematic view in elevation of a pinch roll.
Figure 10:
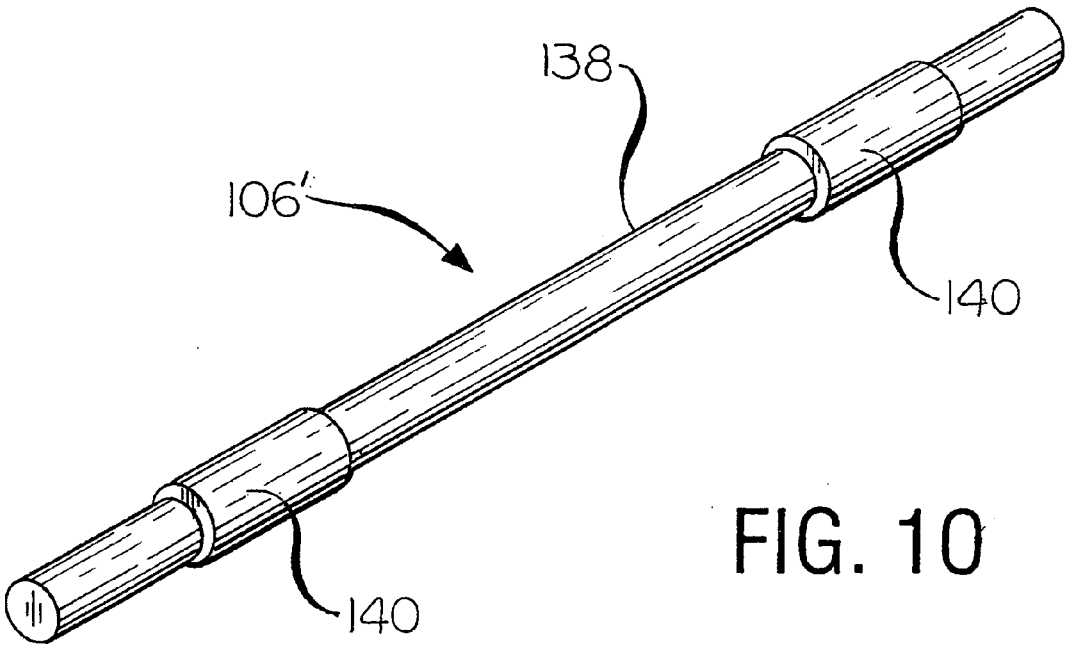
FIG. 10 is a schematic view in elevation of an alternative pinch roll.
Figure 16:
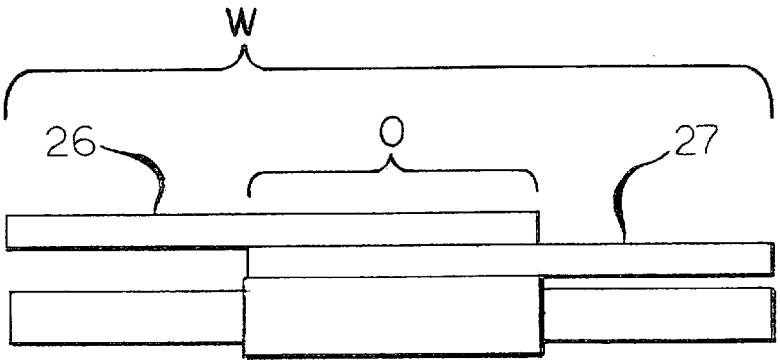
FIGS. 16 and 17 are enlarged, schematic view in elevation of overlapping belts showing the belts overlapping one another by different amounts.

The pinch roll 106 may have a central raised diameter portion 136 (FIG. 9) that is adapted to contact the overlap O (FIGS. 16 and 17) of the belts 26, 27. The central raised diameter portion 136 may prove to be more effective in synchronizing the belts 26, 27 when a substantial overlap O exists (FIG. 16). However, the central raised diameter portion 136 may not be make sufficient contact with a narrow overlap O (FIG. 17) to synchronize the belts 26, 27. An alternative embodiment would include a pinch roller 106' (FIG. 10) having a central reduced diameter portion 138, rendering a stepped surface 140 at each end of the pinch roller 106'. The stepped surfaces 140 are adapted to make simultaneous and continuous contact with non-overlapping portions of the belts 26, 27 to synchronize the speed of the belts 26, 27.

It should be understood that belts 26, 27 driven independently of one another, as opposed to being driven simultaneously by a single drive mechanism or source (i.e., the pinch roll), are intended to be within the scope or spirit of the invention.

Figure 5:
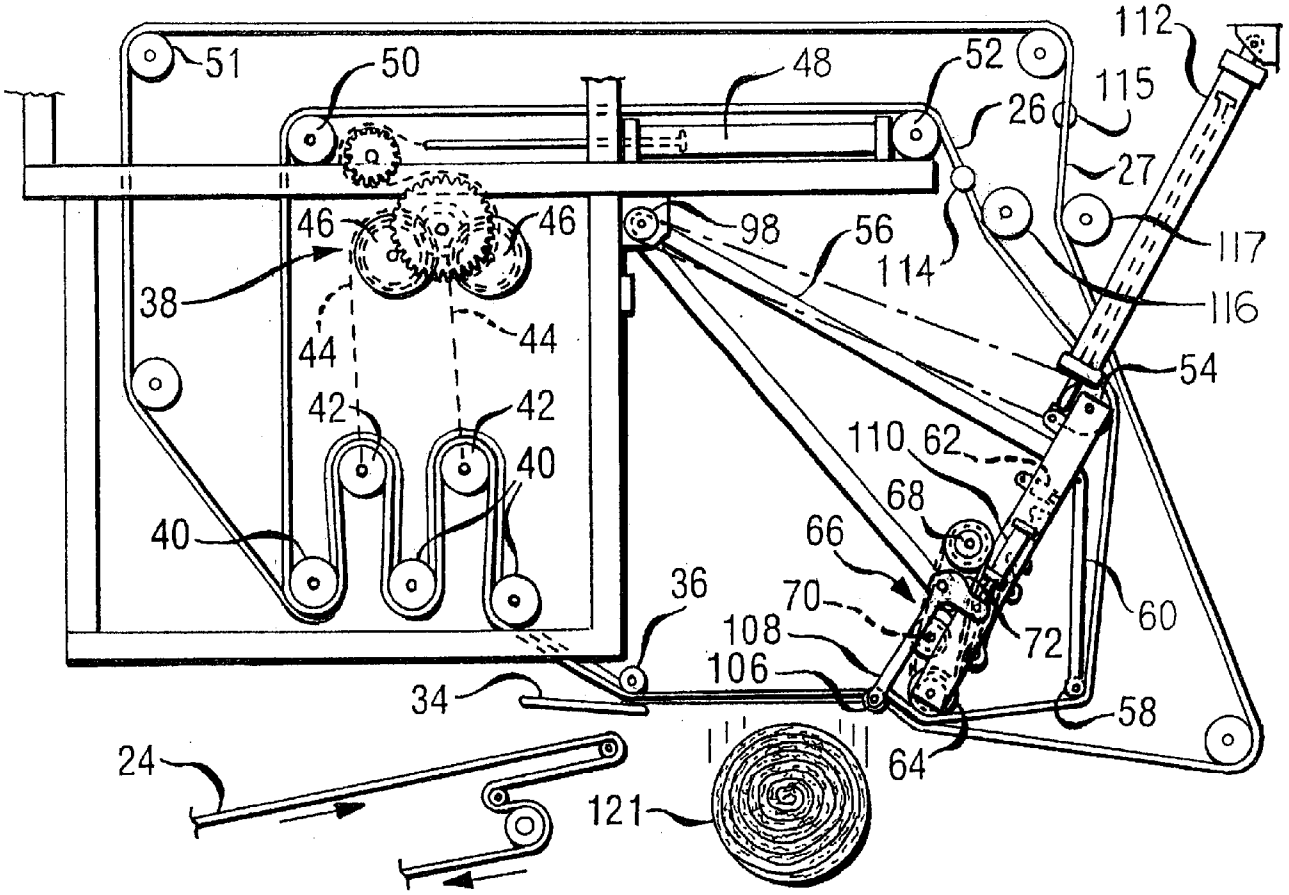

When the package is complete, pivotal sub-frame 56 is opened, as shown in FIG. 5, to straighten the loop 30 and to discharge the package downwardly. For this purpose, a pneumatic ram 112 is connected to a portion of sub-frame 56 and to an upper corner portion of the main frame 28. At this time, the pinch roll 106 is also moved outwardly by the ram 110 to stop the movement of the overlapping belts 26, 27. After discharge, the pinch roll 106 again is moved into engagement with the overlapping belts 26, 27 to cause the belts to immediately begin to be moved by the tail roll 64 and to form a loop 30 again. An apparatus having a single endless belt, similar to belt 26, is discussed in U.S. Pat. No. 4,114,530, herein incorporated by reference.

Figure 11:
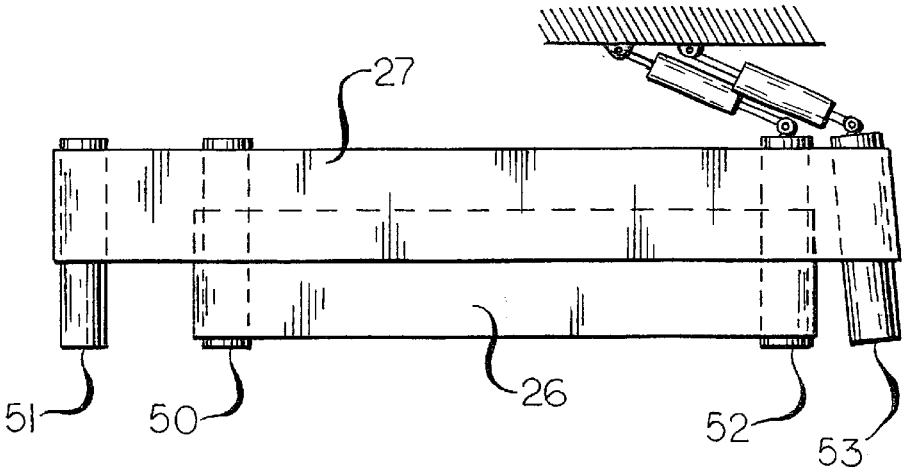
FIG. 11 is an enlarged, schematic view in plan of belts and supporting rolls according to one embodiment of the invention showing a guide roll making a lateral correction in one of the belts.
Figure 12:
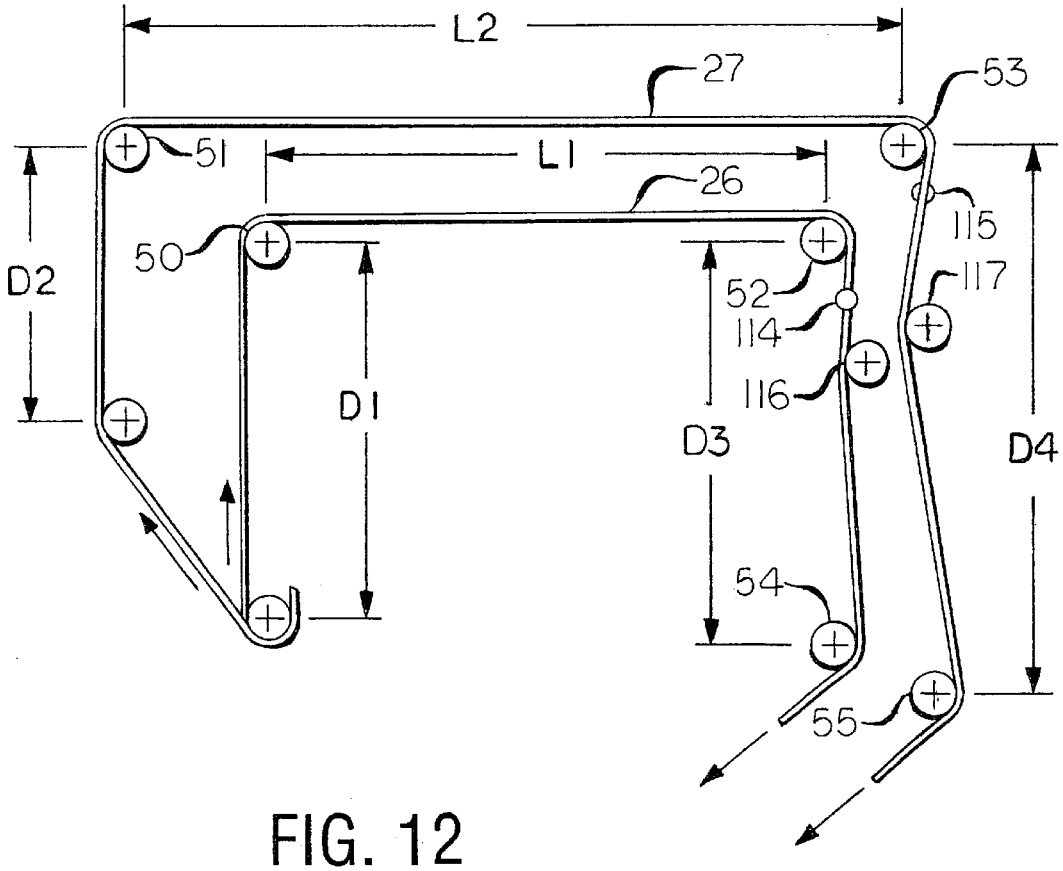
FIG. 12 is a schematic view in elevation of the apparatus shown in FIGS. 1–5.

According to the preferred embodiment of the invention, the guide rolls 52, 53 move laterally and angularly (FIG. 11)

to provide lateral correction of the belts 26, 27 before the belts 26, 27 wrap around the lower idler rolls 54, 55. As shown in FIG. 12, the guide rolls 52, 53 are installed following long, free entering spans L1, L2 of the belts 26, 27. The length of the entering spans L1, L2 is determined by the required maximum correction to be made and the belt tension, as well as the characteristics of the belts 26, 27 being guided. The pre-spans D1, D2 just prior to the entering spans L1, L2 should be shorter than the entering spans L1, L2 to prevent undesirable feedback through the belts 26, 27. It is desirable that the belts 26, 27 wrap the upper idler rolls 50, 51 sufficiently so that the belts 26, 27 will not slip laterally as the guide rolls 52, 53 make corrections. The exit spans D3, D4 are the free span from the guide rolls 52, 53 to the lower idler rolls 54, 55. The length of the exit spans D3, D4 is some value proportionate to the width of the belts 26, 27. It is also desirable that the belts 26, 27 wrap the lower idler rolls 54, 55 sufficiently so that the belts 26, 27 will not slip laterally as the guide rolls 52, 53 make corrections. Sensors 114, 115, preferably paddle sensors, should be fixed and located in the exit span. An example of a suitable paddle sensor is the Model SE-29 Heavy Duty Paddle Sensor Assembly of FIFE Corporation of Oklahoma. Paddle sensors include an element that engages the edge of the belts 26, 27 to monitor the lateral position of the belts 26, 27 to ensure that the belts 26, 27 remain true or in a desired lateral position. A certain range of lateral movement by the belts 26, 27 may be tolerated but if the belts 26, 27 move a predetermine distance outside of the tolerated range, the guide rolls 52, 53 move laterally and angularly (FIG. 11) to bring the edge of the belts 26, 27 back within the tolerated range. The guide rolls 52, 53 should move the belts 26, 27 at a rate (e.g., one-half inch per second) that does not cause the belts 26, 27 to respond erratically. An erratic response may cause the edge of the belts 26, 27 to engage side plates 132 of the apparatus 20 and curl over onto themselves. To further control the belts 26, 27, deadbar or support rolls 116, 117 may be installed to engage the belts 26, 27. The angle of wrap over the support rolls 116, 117 must be minimized and preferably never exceed 10 degrees.

In the preferred embodiment, the guide rolls 52, 53 each form a part of a KAMBEROLLER Guide Assembly manufactured by FIFE Corporation of Oklahoma. The guide assemblies each include a base having an actuator 118, 119 mounted thereon. The actuators 118, 119 move the guide rolls 52, 53 laterally to correct the lateral position of the belts 26, 27. Although it is preferable that the guide assembly be an electro-hydraulic guide system, a pneumo-hydraulic guide system may be used as well.

Figure 13:
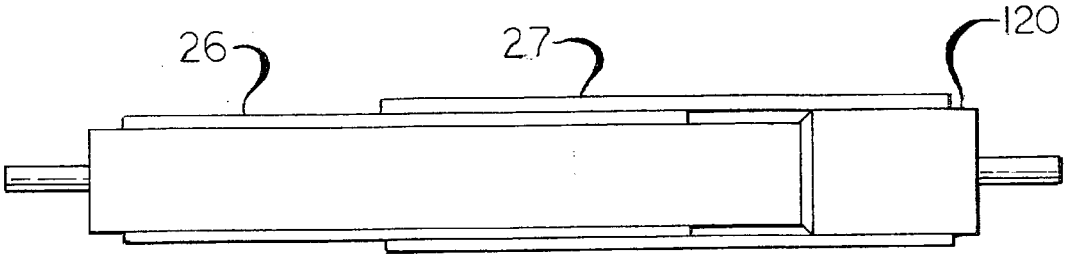
FIG. 13 is an enlarged, schematic view in elevation of a stepped roll supporting overlapping belts.
Figure 14:
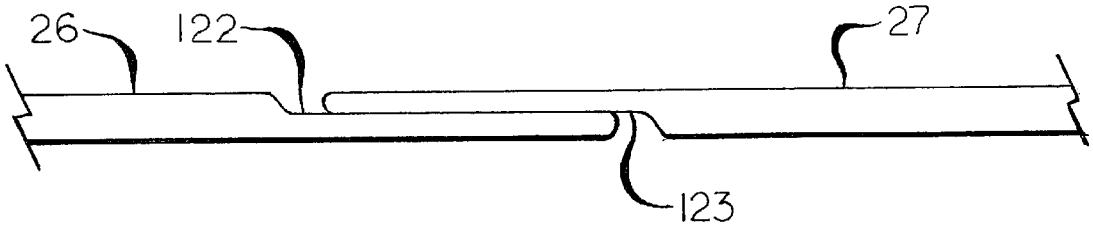
FIG. 14 is an enlarged, fragmentary schematic view in elevation of stepped overlapping belts.
Figure 15:
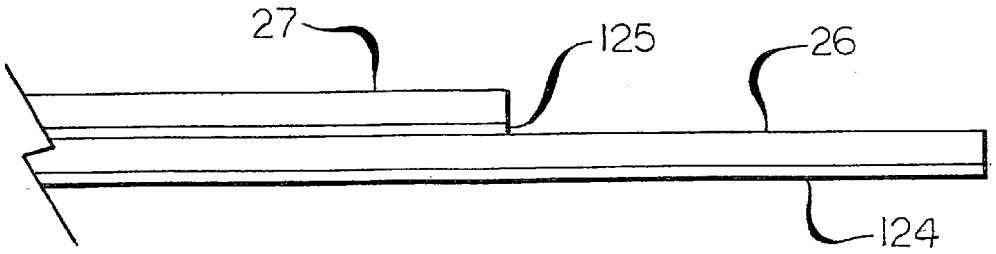
FIG. 15 is an enlarged, fragmentary schematic view in elevation of overlapping belts showing a high-friction surface coating.

Downstream of the guide rolls 52, 53 (i.e., the slack control roll 58 and the rolls downstream of the slack control roll 58), the overlapping belts 26, 27 tend to track relative to one another, or walk or travel laterally, just as belts track to the center of crowned rolls. (A crowned roll is one which gradually increases in diameter towards its center.) This undesirable effect may be minimized by placing a step 120 along an end of the roll, as shown in FIG. 13, to keep the overlapping belts 26, 27 in a substantially uniform plane. Alternatively, the overlapping belts 26, 27 can have a step 122, 123 along opposing edges thereof, as shown in FIG. 14, to keep the overlapping belts 26, 27 in a substantially uniform plane. To further minimize lateral travel of the belts 26, 27, the belts 26, 27 can be constructed of either a monofilament or multifilament belt material having a polyurethane surface 124, 125, as shown in FIG. 15, that engages the rolls. The polyurethane surface 124, 125 grips the rolls to reduce the risk that lateral movement of the belts 26, 27 will occur.

Figure 17:
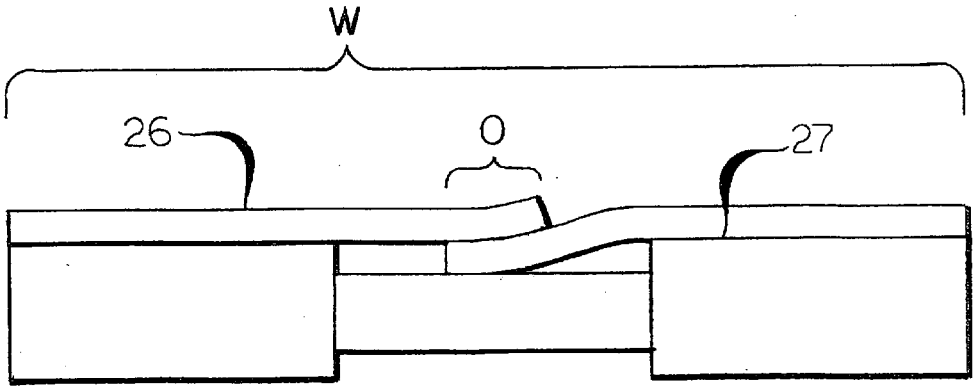

In a preferred embodiment, the belts 26, 27 can also move laterally automatically to adjust the belt overlap O and thus adjust the width W, as shown in FIGS. 16 and 17, of the overlapping belts 26, 27. The belt overlap O is adjustable to permit roll products of various widths to be packaged without producing waste or telescoping roll product. For example, two 40 inch belts can be automatically adjusted to have a 22 inch belt overlap to provide a 58 inch wide belt for simultaneously packaging various roll products having widths the sum of which is about 58 inches. The same two belts can be automatically adjusted to have a four inch overlap to provide a 76 inch wide belt. A four inch overlap is a fairly narrow overlap that may require the use of a pinch roll (e.g., such as the pinch roll 106' shown in FIG. 10 having opposing stepped surfaces 140) to engage the non-overlapping portions of the belts 26, 27 to synchronize the belts 26, 27. Alternatively, the belts 26, 27 may be sufficiently wide (e.g., 58 inches wide) to provide a substantial overlap (e.g., 24 inches). Such an overlap could be suitably synchronized by a pinch roll (e.g., such as the pinch roll 106 shown in FIG. 9) having a central raised diameter portion.

Figure 18:
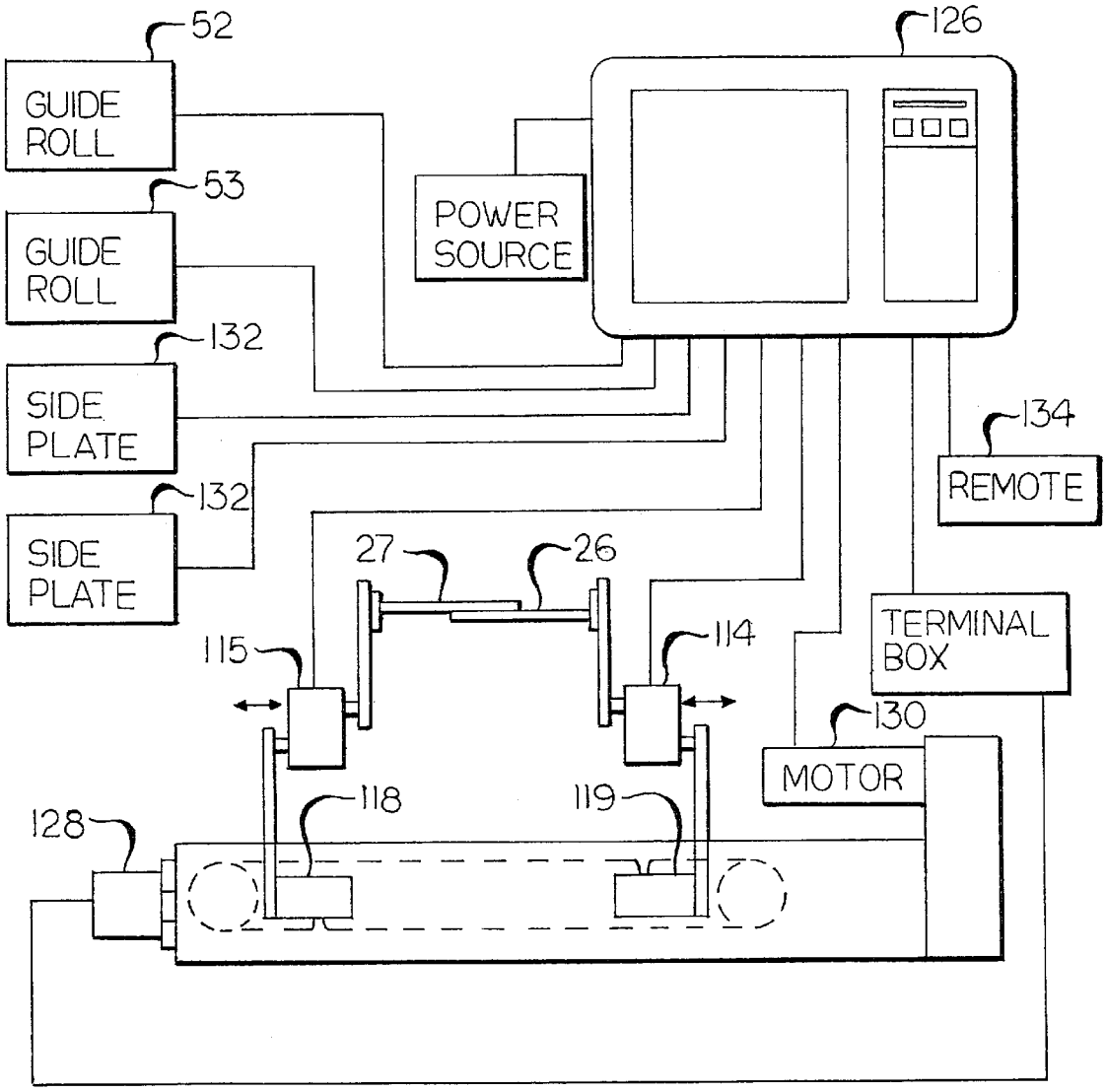
FIG. 18 is a schematic view of a control system according to the preferred embodiment of the invention.

In a preferred embodiment, the belt overlap O is adjustable by moving the sensors 114, 115 laterally. As the sensors 114, 115 are moved, the guide rolls 52, 53 move laterally to adjust the position of the belts 26, 27 relative to the position of the sensors 114, 115. The sensors 114, 115 can be automatically moved by a centralized controller or processor 126, as shown in FIG. 18. A model CDP-01-MHH Triple Drive Digital Signal Processor manufactured by FIFE Corporation of Oklahoma is a suitable processor for carrying out the invention. The processor 126 is adapted to receive input data relating to the roll product being formed. In the preferred embodiment, the processor 126 may receive input data or be controlled from a remote location by a remote control 134. The processor 126 is connected to the sensors 114, 115 sensing the position of the lateral edge of the belts 26, 27. A transducer 128 senses the position of the sensors 114, 115. A motive force, such as the motor 130 shown, is connected to sensor supports (via cables and pulleys or chains and sprockets or the like) for displacing the sensor supports laterally. This displaces the sensors 114, 115 laterally to adjust the belt overlap O and thus, the width W of the overlapping belts 26, 27. The sensors 114, 115 are preferably displaced by equal amounts. As the sensors 114, 115 are displaced, the processor 126 controls the guide roll actuators 118, 119 to laterally move the belts 26, 27. FIFE Corporation of Oklahoma also manufactures a Pro-Trac 200 Continuous-Duty Sensor Positioner which combines self-tracking pulley and cable configuration driven by a servo-motor to position belt tracking sensors. A transducer senses the position of the sensors and produces and electrical signal corresponding to the position. Such a device would be a suitable for carrying out the invention.

Side plates 132 are typically located at opposing sides of the loop 30 move laterally as the belts 26, 27 move laterally so that the side plates 132 remain adjacent the loop 30 to prevent the roll products from telescoping laterally or axially beyond the loop 30. The sensors 114, 115 and the side plates 132 can be automatically moved by the same processor 126.

In the operation of the packaging apparatus 20, the width of the overlapping belts 26, 27 is adjusted as desired. The insulation is carried up conveyor 24 and into the loop 30, as shown in FIGS. 3 and 4. As the insulation is rolled, the sensors 114, 115 monitor the lateral position of the belts 26, 27 to maintain the lateral position of the belts 26, 27. Downstream on the guide rolls 52, 53, the lateral position of overlapping belts 26, 27 maintained by keeping the belts 26,

27 in a uniform plane. The loop 30 enlarges as the roll product is formed. As the loop 30 enlarges, the take-up rolls move downwardly. When the roll product is completely formed, the piston 112 is actuated to move the sub-frame 56 in a counterclockwise direction and straighten the loop 30 to cause the finished package 121 (FIG. 5) to be ejected.

One aspect of the invention is that roll product is produced more efficiently and effectively while minimizing any waste. Since the belt width W (FIGS. 16 and 17) can be adjusted to produce roll product of various widths, the entire surface of the overlapping belts 26, 27 is used to produce roll product. This eliminates the waste that is experienced by conventional non-adjustable belts. Another aspect of the invention is that the side plates 132 are adjusted to the width of the overlapping belts 26, 27 to prevent the roll products from telescoping laterally beyond the loop 30. This produces a roll product that is easier to wrap with stretch film and more suitable for stacking. The invention also permits production rates to be increased. For various reasons, belt roll-up machines are limited in their capacity to produce roll product beyond a certain output which is measured in weight per unit of time (e.g., pounds per hour). The invention produces roll product without producing any waste and thus can operate at greater rates of speed than conventional machines that, from time to time, produce waste.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A belt roll-up machine, comprising:

a main frame; and a pair of endless belts carried by the main frame, the belts overlapping and having a loop formed therein which is in alignment with a conveyor to receive a forward end of a compressible strip of insulation, the overlapping belts having a combined width and being laterally adjustable relative to one another to adjust the combined width of the overlapping belts.

2. The machine of claim 1, wherein the belts are wrapped around guide rolls that are adapted to move laterally with respect to the belts to provide the lateral adjustment of the belts.

3. The machine of claim 2, further including a belt tracking sensor located downstream of each of the guide rolls for sensing the position of each of the belts.

4. The machine of claim 2, wherein each of the guide rolls is adapted to be moved laterally by an actuator.

5. The machine of claim 1, wherein each of the belts is adapted to move laterally by a belt tracking system comprising:

a pair of guide rolls each having a belt wrapped thereon;

an actuator connected to each of the guide rolls for laterally displacing each of guide rolls; and a belt tracking sensor located downstream of each of the guide rolls for sensing the position of each of the belts.

6. The machine of claim 5, wherein a controller is connected to the belt tracking system, the tracking sensors being laterally displaceable by the controller.

7. The machine of claim 6, wherein the controller is adapted to be controlled remotely by a remote control.

8. The machine of claim 5, wherein the sensors are paddle sensors.

9. The machine of claim 1, wherein each of the belts has an edge and a step along the edge.

10. The machine of claim 1, wherein each of the rolls has an end and a step on the end.

11. The machine of claim 1, wherein the belts are driven simultaneously by a single drive mechanism.

12. A belt roll-up machine, comprising:

a main frame;

at least two guide rolls carried by the main frame;

a pair of endless belts each being wrapped around one of the guide rolls, the belts being adapted to overlap and form a loop which is adapted to align with a conveyor to receive a forward end of a compressible strip of insulation, the overlapping belts having a combined width and being laterally adjustable relative to one another to adjust the combined width of the overlapping belts;

at least two sensors each adapted to sense the lateral position of one of the belts; and at least two actuators each connected to one of the guide rolls; and a controller connected to each actuator and each sensor, the controller being adapted to control each of the actuators to laterally and angularly move each of the guide rolls in response to a change in lateral position of each of the belts as sensed by the sensors.

13. The machine of claim 12, wherein each of the sensors is a paddle sensor.

14. The machine of claim 12, wherein a motive force is connected to the sensors and a controller is connected the motive force, the motive force being adapted to be controlled by the controller to laterally displace the sensors.

15. The machine of claim 14, wherein the controller is adapted to be controlled remotely by a remote control.

16. The machine of claim 12, wherein the belts each has an edge and a step along the edge.

17. The machine of claim 12, wherein each of the rolls has an end and a step on the end.

18. The machine of claim 12, wherein the belts are driven simultaneously by a single drive mechanism.

19. A belt roll-up machine, comprising:

a main frame;

a pair of endless belts being adapted to overlap and form a loop which is adapted to align with a conveyor to receive a forward end of a compressible strip of insulation, the overlapping belts having a combined width and being laterally adjustable relative to one another to adjust the combined width of the overlapping belts;

at least two guide rolls carried by the main frame and following a long, free entering span of the belts, each one of the belts being wrapped around one of the guide rolls;

at least two belt tracking sensors each adapted to sense the lateral position of one of the belts;

at least two actuators each connected to one of the guide rolls; and a controller connected to the actuators and the sensors, the controller being adapted to control each of the actuators to laterally and angularly move each of the guide rolls in response to a change in lateral position of each of the belts as sensed by the sensors, and further being adapted to laterally move the sensors to adjust the overlap of the overlapping belts.

20. The machine of claim 19, wherein the controller is adapted to be controlled remotely by a remote control.

21. A belt roll-up machine, comprising:

a main frame; and a pair of endless belts carried by the main frame, the belts having overlapping portions, the overlapping portions forming a loop which is in alignment with a conveyor to receive a forward end of a compressible strip of insulation, the overlapping portions having a combined width and being laterally adjustable relative to one another to adjust the combined width of the overlapping belts.

* * * * *